US012049723B2

(12) United States Patent
Lee et al.

(10) Patent No.: US 12,049,723 B2
(45) Date of Patent: Jul. 30, 2024

(54) APPARATUS FOR TREATING LAUNDRY

(71) Applicant: LG ELECTRONICS INC., Seoul (KR)

(72) Inventors: Jihong Woon Lee, Seoul (KR); Cheong Woon Kim, Seoul (KR); Jeong Hyun Ji, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/227,157

(22) Filed: Jul. 27, 2023

(65) Prior Publication Data

US 2023/0383459 A1 Nov. 30, 2023

Related U.S. Application Data

(63) Continuation of application No. 17/284,395, filed as application No. PCT/KR2019/013349 on Oct. 11, 2019, now Pat. No. 11,746,461.

(30) Foreign Application Priority Data

Oct. 11, 2018 (KR) ..... 10-2018-0121112

(51) Int. Cl.
*D06F 39/12* (2006.01)
*D06F 31/00* (2006.01)
*D06F 34/20* (2020.01)

(52) U.S. Cl.
CPC ..... *D06F 39/125* (2013.01); *D06F 31/00* (2013.01); *D06F 34/20* (2020.02)

(58) Field of Classification Search
CPC ..... D06F 39/125
See application file for complete search history.

(56) References Cited

U.S. PATENT DOCUMENTS

| | | | |
|---|---|---|---|
| 2015/0345063 | A1 | 12/2015 | Sang et al. |
| 2018/0100258 | A1 | 4/2018 | Sang et al. |
| 2018/0195223 | A1 | 7/2018 | Choi et al. |
| 2019/0017209 | A1 | 1/2019 | Jung et al. |

FOREIGN PATENT DOCUMENTS

| | | | |
|---|---|---|---|
| EP | 3 112 516 | A1 | 1/2017 |
| KR | 10-2010-0117972 | A | 11/2010 |
| KR | 10-1123323 | B1 | 3/2012 |
| KR | 10-1398425 | B1 | 5/2014 |
| WO | WO 2017/119696 | A2 | 7/2017 |

OTHER PUBLICATIONS

International Search Report for International Application No. PCT/KR2019/013349, dated Feb. 7, 2020 (10 pages).

*Primary Examiner* — Jason Y Ko
(74) *Attorney, Agent, or Firm* — Birch, Stewart, Kolasch & Birch, LLP

(57) ABSTRACT

An apparatus for treating laundry includes a cabinet having a top surface providing a space for seating an object therein, a front surface provided with a first perforated hole and a second perforated hole and a top surface perforated hole configured to perforating the top surface, a drawer drawable from the cabinet through the first perforated hole, a drum rotatably provided within the drawer to provide a space for storing the laundry therein, a slide exposed to the front surface of the cabinet through the second perforated hole to maintain a state that the drawer is drawn from the cabinet in a preset reference distance, and a transfer part exposed to the top surface of the cabinet through the top surface perforated hole so as to move the slide into the cabinet if an object is seated on the top surface.

12 Claims, 5 Drawing Sheets

【Figure 1】
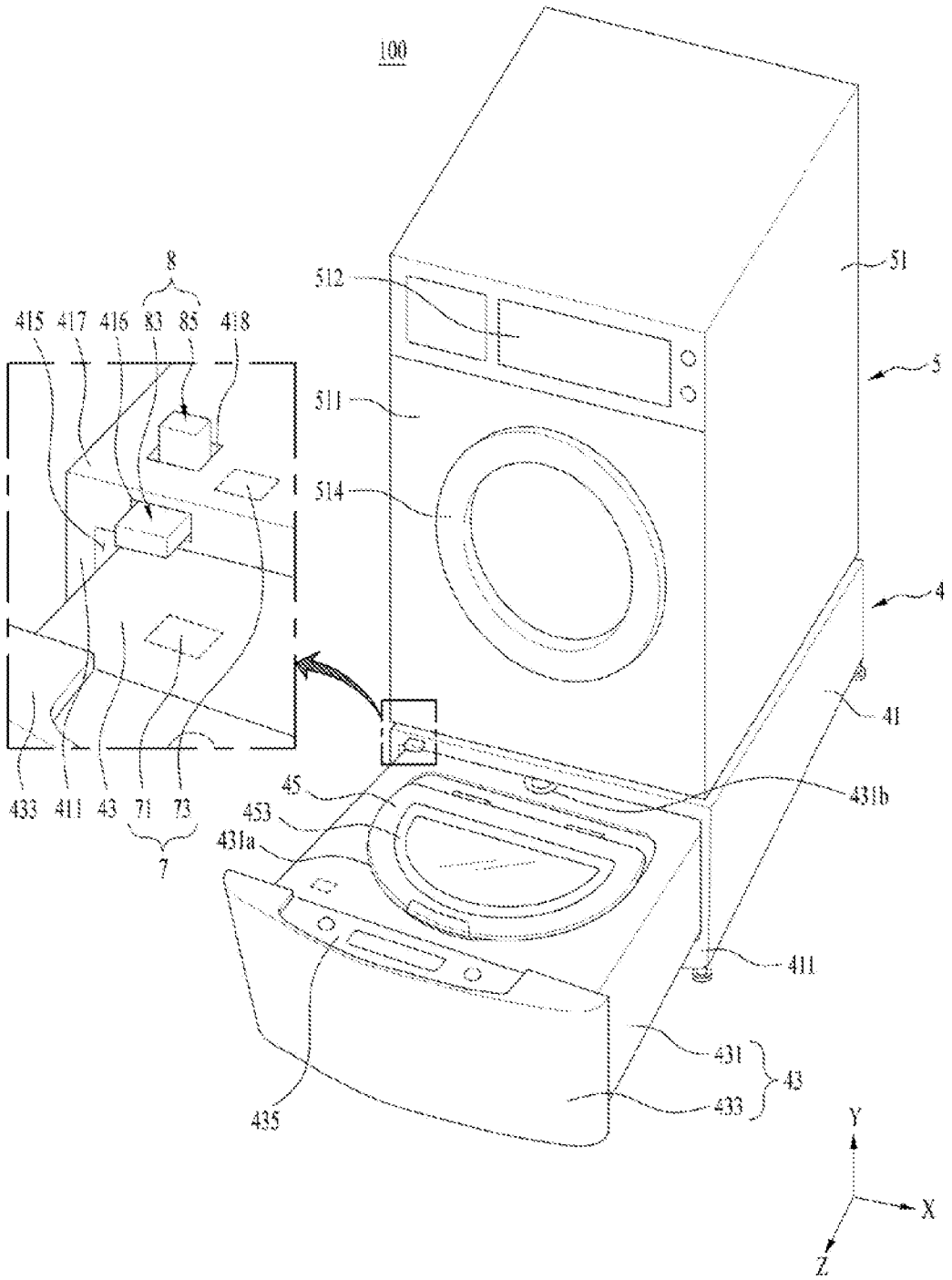

【Figure 2】
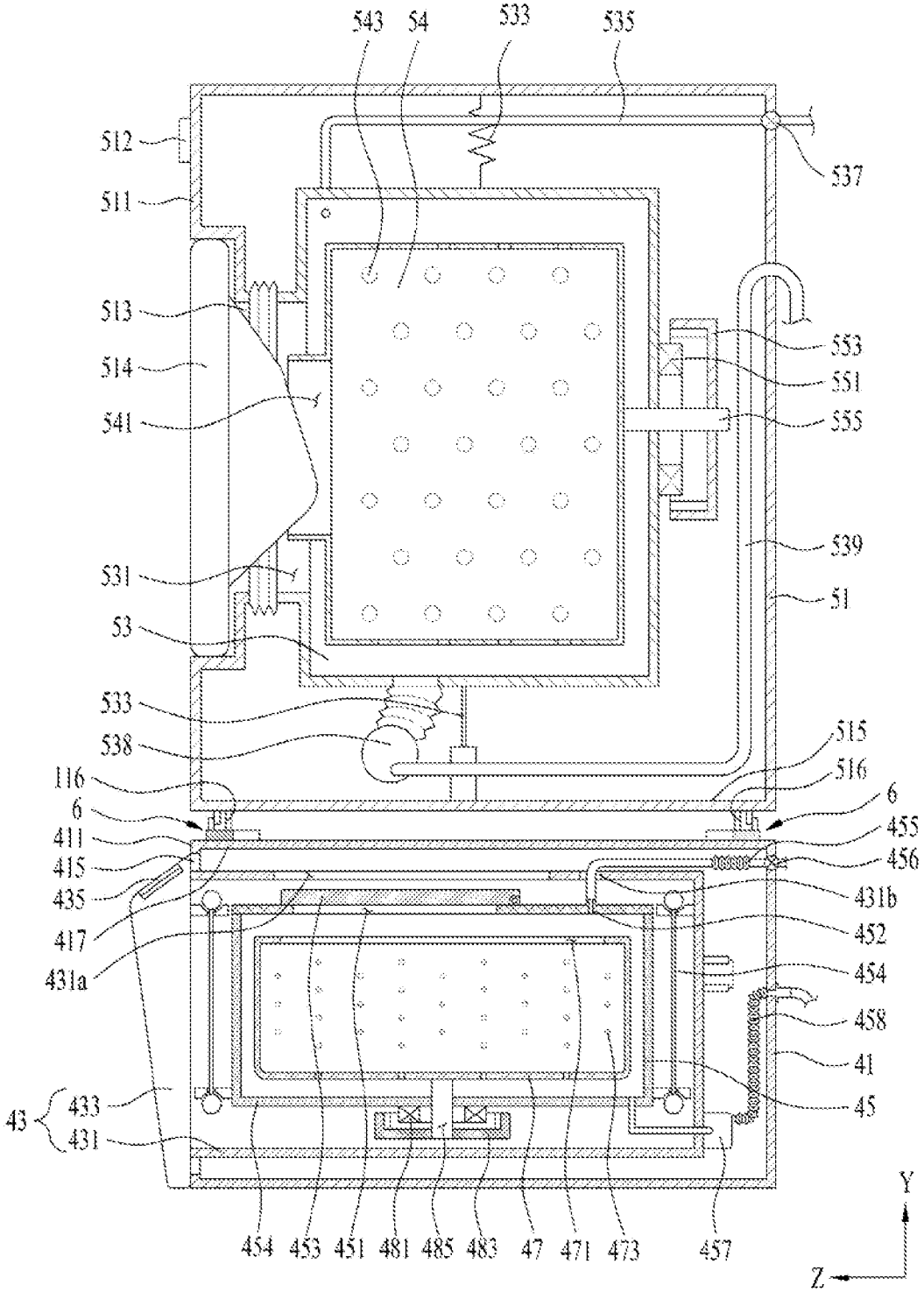

【Figure 3】
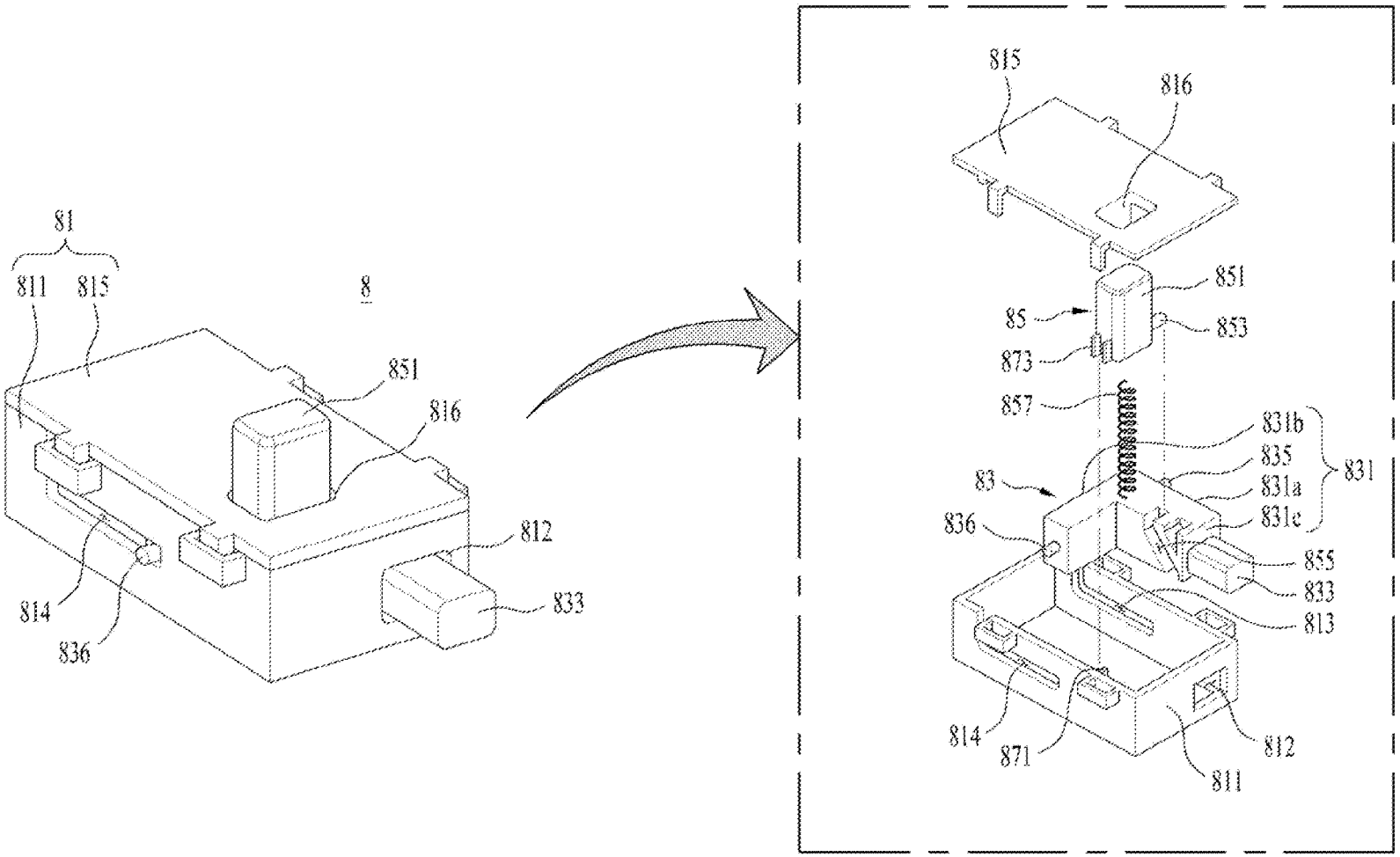

【Figure 4】
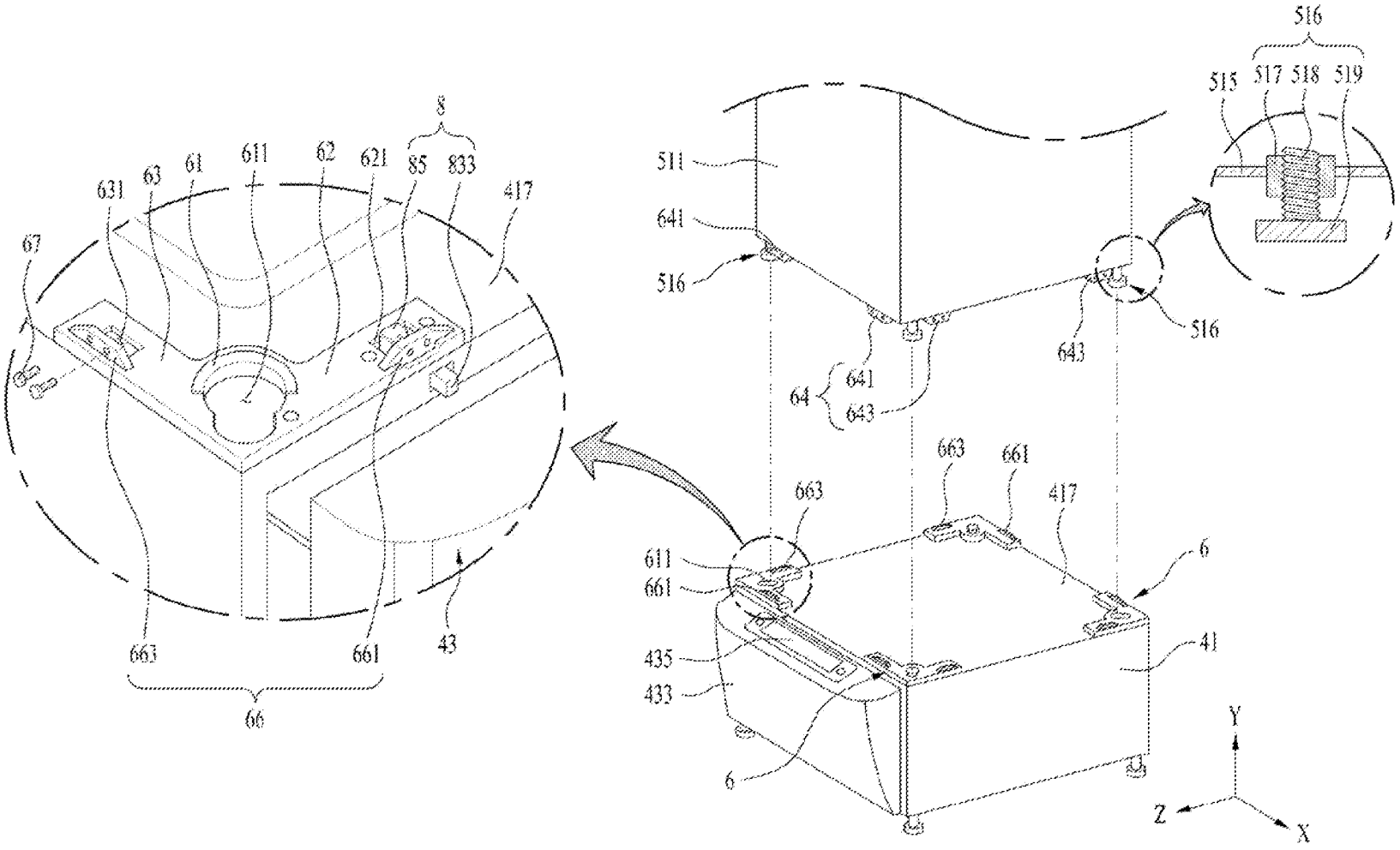

【Figure 5】
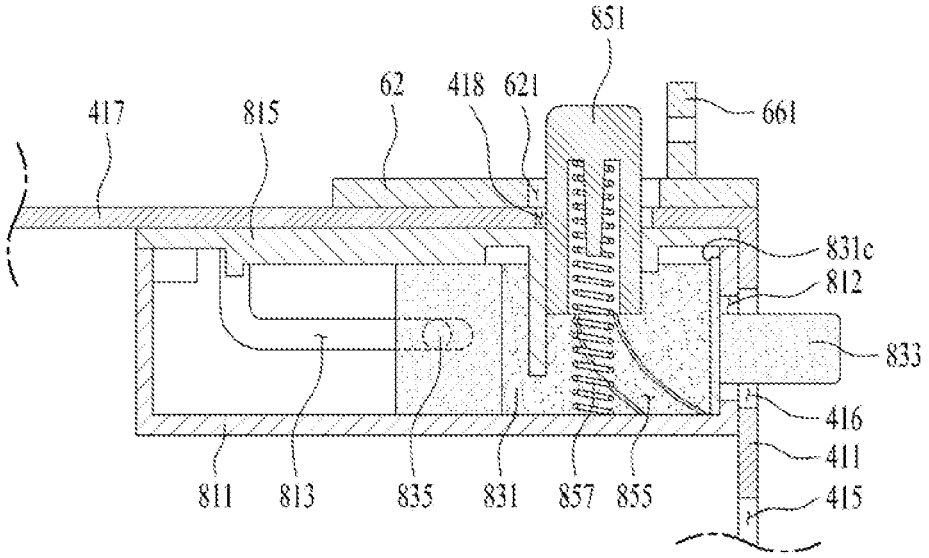
(a)
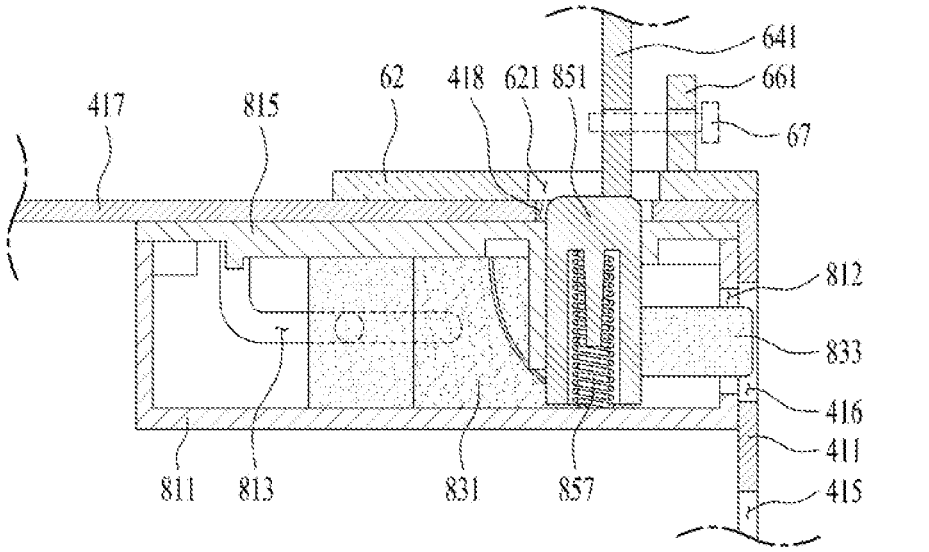
(b)

APPARATUS FOR TREATING LAUNDRY

CROSS-REFERENCE TO RELATED APPLICATIONS

This application is a Continuation of U.S. application Ser. No. 17/284,395, filed on Apr. 9, 2021, which is the National Phase under 35 U.S.C. § 371 of International Application No. PCT/KR2019/013349, filed on Oct. 11, 2019, which claims the benefit under 35 U.S.C. § 119(a) to Patent Application No. 10-2018-0121112, filed in the Republic of Korea on Oct. 11, 2018, all of which are hereby expressly incorporated by reference into the present application.

TECHNICAL FIELD

The present application relates to an apparatus for treating laundry.

BACKGROUND ART

Generally, a laundry treating device conceptually includes a laundry washing device, a laundry drying device and a device capable of washing and drying laundry.

In a laundry treating device of a front loading type (generally called a drum washer) capable of loading laundry through a front side, an entrance for putting laundry into the device is formed at a location lower than a user's waist, when the user puts laundry into the laundry treating device or takes the laundry out of the laundry treating device, it is inconvenient for the user to bend over.

To resolve such inconvenience, in some of the related art laundry treating devices, a drawer type pedestal is added to a bottom of a laundry treating device of a front loading type, whereby a height of the entrance is raised.

Moreover, among the related art laundry treating devices, the drawer type pedestal plays a role in washing or drying laundry while playing a role as a means for supporting a bottom surface of the laundry treating device of the front loading type.

However, regarding the drawer type laundry treating device capable of washing or drying laundry, when a drawer is pulled out of a cabinet for washing or drying, center of gravity moves along the drawer, thereby causing a problem that the drawer type laundry treating device is inclined toward direction in which the drawer is pulled out.

DISCLOSURE OF INVENTION

Technical Problem

Accordingly, embodiments of the present application are directed to a laundry treating apparatus that substantially obviates one or more problems due to limitations and disadvantages of the related art.

One technical task of the present application is to provide a laundry treating apparatus of a drawer type capable of washing or drying laundry, which is configured to support a device for laundry treatment (e.g., a dryer, a washer, a dryer washer, etc.).

Another technical task of the present application is to provide a laundry treating apparatus capable of performing a laundry treatment function only if a separate laundry treatment device is seated on a top side.

Technical tasks obtainable from the present application are non-limited by the above-mentioned technical tasks. And, other unmentioned technical tasks can be clearly understood from the following description by those having ordinary skill in the technical field to which the present application pertains.

Solution to Problem

Additional advantages, objects, and features of the invention will be set forth in the disclosure herein as well as the accompanying drawings. Such aspects may also be appreciated by those skilled in the art based on the disclosure herein.

To achieve these objects and other advantages and in accordance with the purpose of the application, as embodied and broadly described herein, an apparatus for treating laundry according to one embodiment of the present application includes a cabinet having a top surface providing a space for seating an object therein, a front surface provided with a first perforated hole and a second perforated hole and a top surface perforated hole configured to perforating the top surface, a drawer drawable from the cabinet through the first perforated hole, a drum rotatably provided within the drawer to provide a space for storing the laundry therein, a slide exposed to the front surface of the cabinet through the second perforated hole to maintain a state that the drawer is drawn from the cabinet in a preset reference distance, and a transfer part exposed to the top surface of the cabinet through the top surface perforated hole so as to move the slide into the cabinet if an object is seated on the top surface.

The apparatus may further include a drum drive unit revolving the drum, a magnet provided to one of the drawer and the cabinet, a magnetic force detecting unit provided to the other one of the drawer and the cabinet to detect a magnetic force of the magnet, and a controller activating the drum drive unit only if the magnetic force detecting unit detects the magnetic force of the magnet.

The reference distance may be set to a distance for the magnetic force detecting unit not to detect the magnetic force of the magnet.

The apparatus may further include a drum drive unit revolving the drum, a magnet provided to one of the drawer and the cabinet, a magnetic force detecting unit provided to the other one of the drawer and the cabinet to detect a magnetic force of the magnet, and a controller activating the drum drive unit only if the magnetic force detecting unit detects the magnetic force equal to or greater than a preset reference value.

The reference distance may be set to a distance enough for the magnetic force detecting unit to detect the magnetic force smaller than the reference value.

The transfer part may include a transfer body having one end exposed to the top surface of the cabinet by perforating the top surface perforated hole and the other end located within the cabinet, a transfer projection provided to the transfer body, and a transfer recess provided to the slide to provide a space for receiving the transfer projection therein so as to move the slide to an inside of the cabinet if the transfer projection moves toward the inside of the cabinet.

The slide may include a sliding body located within the cabinet and provided with the transfer recess and a support body having one end fixed to the sliding body and the other end exposed to a front surface of the second cabinet through the second perforated hole.

The apparatus may further include a housing fixed to the cabinet and providing a space for receiving the sliding body therein, a first housing perforated hole configured to perforate a surface facing the front surface of the cabinet in the space provided by the housing so as to have the support body inserted therein, a second housing perforated hole configured to perforate a surface facing the top surface of the cabinet in the space provided by the housing so as to have the transfer body inserted therein, a fastening part provided to the sliding body, and a guide provided to the housing along a moving direction of the sliding body to provide a moving path of the fastening part.

The apparatus may further include a projection provided to one of the housing and the transfer body and a projection receiving recess provided to the other one of the housing and the transfer body along a direction side by side with a moving direction of the transfer body to provide a moving path of the projection.

The object may include a second cabinet seated on the top surface of the cabinet, a second entrance provided to the second cabinet, and a second drum rotatably provided within the second cabinet to provide a space for storing laundry supplied through the second entrance therein.

The apparatus may further include a first connecting body projected from the second cabinet toward the top surface of the cabinet and pressurizing the transfer body into the cabinet if the second cabinet is seated on the top surface of the cabinet, a second connecting body projected from the top surface of the cabinet toward the second cabinet, and a fastening member coupling the first connecting body and the second connecting body to each other.

The apparatus may further include a leg projected from the second cabinet toward the top surface of the cabinet, a bracket provided to the top surface of the cabinet to provide a space for receiving a bottom surface of the leg therein, the bracket provided with the second connecting body, and a bracket perforated hole located above the top surface perforated hole by perforating the bracket so as to have the transfer body inserted therein.

Further scope of applicability of the present application will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

Advantageous Effects of Invention

Accordingly, embodiments of the present application provide various effects and/or features.

The present application brings an effect of providing a laundry treating apparatus of a drawer type capable of washing or drying laundry, which is configured to support a device for laundry treatment (e.g., a dryer, a washer, a dryer washer, etc.).

The present application brings an effect of providing a laundry treating apparatus capable of performing a laundry treatment function only if a separate laundry treatment device is seated on a top side.

Effects obtainable from the present application may be non-limited by the above mentioned effect. And, other unmentioned effects can be clearly understood from the following description by those having ordinary skill in the technical field to which the present application pertains.

BRIEF DESCRIPTION OF DRAWINGS

The present application will become more fully understood from the detailed description given herein below and the accompanying drawings, which are given by illustration only, and thus are not limitative of the present application, and wherein:

FIG. 1 and FIG. 2 are diagrams showing one example of a laundry treating apparatus;

FIG. 3 is a diagram showing one example of a second detecting unit provided to a laundry treating apparatus;

FIG. 4 is a diagram showing one example of a cabinet connecting part provided to a laundry treating apparatus; and FIG. 5 shows an operating process of a second detecting unit.

BEST MODE FOR CARRYING OUT THE INVENTION

Reference will now be made in detail to the present application using drawings and embodiments specifying components of the present application, which are just used to help the understanding of the present application.

In the following, a laundry treating apparatus according to one preferred embodiment of the present application is described in detail with reference to the accompanying drawings.

FIG. 1 and FIG. 2 are diagrams showing one example of a laundry treating apparatus.

A laundry treating apparatus 100 may be configured to include a first handling device 4 only or include both a first handling device 4 and a second handling device 5 located on the first handling device 4. FIG. 1 shows one example of a case that the laundry treating apparatus 100 includes both of the first handling device 4 and the second handling device 5.

The first handling device 4 is a device capable of washing, drying or washing & drying of laundry and includes a first cabinet 41 having a top surface on which an object can be seated, a drawer drawable from the first cabinet 41, and a first laundry receiving part provided within the drawer to store laundry therein.

The first cabinet 41 may be configured in a hexahedral shape, including a front surface 411 provided with a first perforated hole 415 and a second perforate hole 416 and a top surface 417 provided with a top surface perforated hole 418.

The drawer 43 is configured to include a drawer body 431 pulled out of the first cabinet 41 through the first perforated hole 415 and a drawer panel 433 configured to open/close the first perforated hole by being fixed to the drawer body 431.

If the drawer panel 433 opens the first perforated hole 415, it means that when the drawer body 431 is pulled out of the first cabinet 41, the drawer panel 433 enables the first perforated hole 415 to be externally exposed. Meanwhile, if the drawer panel 433 closes the first perforated hole 415, it means that as the drawer body 431 is inserted in the first cabinet 41, the first perforated hole 415 is not exposed outside the first cabinet 41 by the drawer panel 433.

A first drawer perforated hole 431*a* and a second drawer perforated hole 431*b* are provided to a top surface of the drawer body 431. The first drawer perforated hole 431*a* is a means for supplying laundry to a first laundry receiving part and the second drawer perforated hole 431*b* is a means for supplying water to the first laundry receiving part, which shall be described in detail later.

A first control panel 435 may be provided to a top surface of the drawer panel 433. And, the first control panel 435 may be provided with an input unit configured to receive an input of a control command from a user and a display unit configured to display a user-selectable control command or display a progress process of a user-selected control command.

If the first handling device 4 is a device configured for the purpose of laundry drying only, the first laundry receiving part may include a first drum rotatably provided within the drawer so as to store laundry therein only. Yet, if the first handling device 4 is a device configured for the purpose of laundry washing, as shown in FIG. 2, the first laundry receiving part may include a first tub 45 provided within the drawer body 431 so as to store water therein and a first drum 47 rotatably provided within the first tub 45 so as to store laundry therein.

The first tub 45 may be configured in a hollow cylindrical shape and fixed to the drawer 431 through a first tub support part 454. A first entrance 451 through which laundry is supplied and a first handling device door (i.e., first door) 453 configured to open/close the first entrance 451 may be provided to a top surface of the first tub 45.

The first door 453 may be configured to be located under the first drawer perforated hole 431*a*. Hence, the first door 453 may be revolved through the first drawer perforated hole 431*a* in a direction of getting away from the first entrance 451.

The first tub 45 is supplied with water through a first water supply part, and the first water supply part may include a first water supply pipe 455 connecting a water supply source to the first tub 45 and a first valve 456 configured to open/close the first water supply pipe 455. The first water supply pipe 455 may be configured to connect a supply inlet 452, which perforates a top surface of the first tub by being inserted in the second drawer perforated hole 431*b*, to the water supply source. As the drawer 43 is configured to be drawable from the first cabinet 41, the first water supply pipe 455 is preferably configured with an in-length stretchable and contractible structure or substance.

The water stored in the first tub 45 is externally discharged from the first cabinet 41 through a first drain part. The first drain part may include a first pump 457 fixed to the drawer 43 so as to move the water stored in the first tub 45 to an outside of the drawer 43 and a first drain pipe 458 configured to guide the water discharged from the first pump 457 to an outside of the first cabinet 41. And, the first drain pipe 458 is preferably configured with an in-length stretchable and contractible structure or substance.

The first drum 47 may be configured in a hollow cylindrical shape, and a first drum entrance 471 is provided to a top surface of the first drum 47. The first drum entrance 471 is preferably located under the first entrance 451. A multitude of communicating holes 473 configured to enable an inside of the first tub 45 to communicate with an inside of the first drum may be provided to a circumferential surface and a bottom surface of the first drum 47.

The first drum 47 is revolved by a first drum drive unit controlled by a first controller. The first drum drive unit may include a stator 481 fixed to a bottom surface of the first tub 45, a rotor 483 rotated by a rotating magnetic field provided by the stator, and a first drum rotatable shaft 485 connecting the rotor 483 and the first drum 47 together by perforating the bottom surface of the first tub.

The first drum rotatable shaft 485 may be configured to be orthogonal to the bottom surface of the first tub 45. If the first drum rotatable shaft 485 is configured to be orthogonal to the bottom surface of the first tub, it means that an angle between the first drum rotatable shaft 485 and the bottom surface of the first tub 45 forms 90 degrees within an error range (e.g., assembly tolerance, etc.).

The first handling device 4 may further include an air supply unit (not shown) configured to dry laundry by supplying heated air to the laundry.

An object seated on the top surface 417 of the first cabinet 41 may be the second handling device 5. And, the second handling device 5 may include a second cabinet 51 and a second laundry receiving part provided within the second cabinet so as to store laundry therein.

The second cabinet 51 may include a base 515 forming a bottom surface and a front panel 511 forming a front surface. A second control panel 512 and a second entrance 513 are provided to the front panel 511. And, the second control panel 435 may be provided with a second input unit configured to receive an input of a control command from a user and a second display unit configured to display a user-selectable control command. And, the second entrance 513 may be opened/closed by a second door 514 rotatably fixed to the second cabinet 51.

A multitude of legs 516 are provided to the base 515. The leg 516 is a means for fixing the second cabinet 51 to the top surface 417 of the first cabinet by being seated on the top surface of the first cabinet 41. The leg 516 can be provided to each corner of the base 515 in rectangular shape.

If the second handling device 5 is a device configured for the purpose of laundry drying only, the second laundry receiving part may include a second drum 54 rotatably provided within the drawer so as to store laundry therein only. Yet, if the second handling device 5 is a device configured for the purpose of laundry washing, as shown in FIG. 2, the second laundry receiving part may include a second tub 53 provided within the second cabinet 51 so as to provide a space for storing water therein and a second drum 57 rotatably provided within the second tub so as to store laundry therein.

The second tub 53 may be configured in a hollow cylindrical shape and include a second tub entrance 531 provided to a front surface so as to communicate with the second entrance 513. And, the second tub 53 is fixed to an inside of the second cabinet 51 through a second tub support part 533.

The second tub 45 is supplied with water through a second water supply part and discharges water stored therein to an outside of the second cabinet 51 through a second drain part. The second water supply part may include a second water supply pipe 535 connecting a water supply source to the second tub 53 and a second valve 537 configured to open/close the second water supply pipe.

The second drain part may include a second pump 538 discharging the water stored in the second tub 53 to an outside of the second tub and a second drain pipe 539 configured to guide the water discharged from the second pump to an outside of the second cabinet.

The second drum 54 may be configured in a hollow cylindrical shape. A second drum entrance 541 is provided to a front surface of the second drum so as to communicate with the second tub entrance 531, and a multitude of communicating holes 543 configured to enable an inner space of the second drum to communicate with the second tub may be provided to a circumferential surface and backside of the second drum.

The second drum 54 is revolved by a second drum drive unit controlled by a second controller. The second drum drive unit may include a stator 551 fixed to a backside of the second tub, a rotor 553 rotated by a rotating magnetic field provided by the stator 551, and a second drum rotatable shaft 555 connecting the rotor 553 and the backside of the second drum 54 together by perforating the backside of the second tub 53. The second drum rotatable shaft 555 may be provided side by side with the base 515.

Once the above-described second handling device 5 is seated on the top surface 417 of the first handling device 4, although the drawer 43 of the first handling device is pulled out of the first cabinet 41, it is able to solve a problem that the first handling device 4 is inclined. Yet, if a user removes the second handling device 5 from the top surface of the first handling device 4, it is unable to expect such an effect.

In order to ensure that an object such as the second handling device 5 is located on the top surface of the first handling device 4, the laundry treating apparatus of the present application may further include a detecting unit.

As shown in FIG. 1, the detecting unit may include a first detecting unit 7 detecting whether the drawer 43 is in a state of being inserted in the first cabinet 41 (e.g., a state that the drawer panel closes the first perforated hole) and a second detecting unit 8 detecting whether the second handling device 5 is seated on the top surface 417 of the first cabinet.

The first detecting unit 7 may include a magnet 71 fixed to one of the drawer 43 and the first cabinet 41 and a magnetic force detecting unit 73 provided to the other one of the drawer 43 and the first cabinet 41 so as to detect a magnetic force of the magnet 71. FIG. 1 shows one example of a case that the magnet 71 is fixed to a top surface of the drawer body 431 and that the magnetic force detecting unit 73 is provided to the first cabinet 41.

The first controller may control the first drum drive unit to revolve the first drum only if the magnetic force detecting unit 73 is able to detect a magnetic force of the magnet 71 or senses a magnetic force equal to or greater than a preset reference value.

The second detecting unit 8 includes a slide 83 exposed from the front surface 411 of the first cabinet through the second perforated hole 416 so as to maintain a state that the drawer 43 is pulled out in a preset reference distance from the front surface 411 and a transfer part 85 exposed from the top surface 417 of the first cabinet through a top surface perforated hole 418 provided to the first cabinet.

The transfer part 85 is a means for moving the slide 83 into the cabinet 41 if an object such as the second handling device 5 is seated on the top surface 417 of the first cabinet. Once the slide 83 is moved toward an inside of the first cabinet 41 by the transfer part 85, as the drawer 43 can be moved to a position at which the drawer panel 431 closes the first perforated hole 415, a space between the drawer panel 433 and the front surface 411 may get shorter than the reference distance.

When the first drum 47 is configured to be revolved only if the first detecting unit 7 detects the magnetic force of the magnet 71, the reference distance may be set to a distance in which the magnetic force detecting unit 73 cannot detect the magnetic force of the magnet 71. On the other hand, when the first drum 47 is configured to be revolved only if the first detecting unit 7 detects the magnetic force equal to or greater than the reference value, the reference distance may be set to a distance in which the magnetic force detecting unit 73 detects a magnetic force smaller than the reference value. Therefore, according to the present application, only if an object is seated on the top surface 417 of the first cabinet, the drawer panel 433 can close the first perforated hole 415. And, the first drum drive unit can rotate the first drum only if the drawer panel moves to a position for closing the first perforated hole.

As shown in FIG. 3, the slide 83 may be provided to reciprocate within a housing 81 fixed to the inside of the first cabinet 41.

The housing 81 may include a housing body 811 providing a space for receiving the slide 83 therein and a housing cover 815 forming a top surface of the housing by being fixed to the housing body 811.

The housing body 811 may be configured in a hollow hexahedral shape, and a first housing perforated hole 812 is provided to a surface facing the front surface 411 of the first cabinet. The housing cover 815 is fixed to the housing body 811 and forms a top surface of the housing 81 toward the top surface 417 of the first cabinet. And, a second housing perforated hole 816 is provided to the housing cover 815.

The slide 83 includes a sliding body capable of reciprocating within the housing body 811 and a support body 833 inserted in the first housing perforated hole 812 by being fixed to the sliding body 831.

The sliding body 831 may include a first body 831*a* having the support body 833 fixed thereto and a second body 831*b* capable of reciprocating within the housing body 811 by being fixed to the first body 831*a*. The first body 831*a* may be provided as a bar side by side with a moving direction of the drawer, and the second body 831*b* may be provided as a bar provided along a direction orthogonal to the moving direction of the drawer.

In order to prevent one end of the first body 831*a* from being pulled out of the housing 81 through the housing perforated hole 812, a stopper 831*c* having a cross-sectional area greater than that of the first body 831*a* may be provided to one end of the first body 831*a*. In this case, the support body 833 may be fixed to the stopper 831*c*.

In order to provide a reciprocating path of the sliding body 831, a guide 813 and 814 is provided to the housing body 811 and a coupling part 835 coupling to the guide may be further provided to the second body 831*b*.

The guide may include a first guide 813 and a second guide 814 provided to the housing body along a moving direction of the sliding body 831. FIG. 3 shows one example of a case that the guide 813 and 814 is provided as first and second slits configured to perforate both lateral sides of the housing body 811, respectively. In this case, the housing body 811 may be further provided with a first slit guide connecting the first guide to a top end of the housing body and a second slit guide connecting the second guide 814 to the top end of the housing body. This is to facilitate the coupling part to move to the guide 813 and 814.

The coupling part may include a first coupling part 835 inserted in the first guide 813 by being projected from one of both lateral sides of the second body 831*b* and a second coupling part 836 inserted in the second guide 814 by being projected from the other one of both of the lateral sides of the second body 831*b*.

One end of the support body 833 is fixed to the sliding body 831 and the other end (i.e., a free end) is exposed through the front surface of the first cabinet by being inserted in the first housing perforated hole 816 and the second perforated hole 416 of the first cabinet.

The transfer part 85 includes a transfer body 851 having one end located within the housing 81 and the other end (i.e., a free end) exposed to an outside of the housing by being inserted in the second housing perforated hole 816, a transfer projection 853 provided to the transfer body, and a transfer recess 855 provided to the sliding body 831 so as to provide a space for receiving the transfer projection 853 therein.

The free end of the transfer body 851 perforates the top surface perforated hole 418, thereby being exposed through the top surface 417 of the first cabinet. If the second handling device 5 is seated on the top surface of the first cabinet, the free end of the transfer body 851 will be moved toward an inside of the first cabinet 41 (e.g., toward an inside of the housing) by the second cabinet 51.

The transfer recess 855 is configured to move the support body 833 into the housing 81 when the transfer projection 853 moves toward the inside of the first cabinet 41. FIG. 3 shows one example of the transfer recess 855 provided to the first body 831*a* in a manner of being configured to gradually incline downward toward the support body 833.

The transfer body 851 may be configured to be provided with a restoration force through a spring 857. One end of the spring 857 is fixed to the housing body 811 and the other end is fixed to the transfer body 851. The spring 857 is configured to pressurize the transfer body 851 in a direction of the housing cover 815. Hence, if the second handling device 5 is removed from the top surface of the first handling device 4, the free end of the transfer body 851 may be exposed through the top surface 417 of the first cabinet by the spring 857.

The second detecting unit 8 may further include a transfer part guide providing a reciprocating path of the transfer part 85. The transfer part guide may include a projection 871 provided to one of the housing 81 and the transfer body 851 and a projection receiving recess 873 provided to the other one of the housing 81 and the transfer body 851 so as to provide a moving path of the projection 871.

As shown in FIG. 4, the first handling device 4 and the second handling device 5 may be coupled to each other through a cabinet connecting part 6.

The cabinet connecting part 6 may include a bracket fixed to the top surface 417 of the first cabinet, a first connecting body 64 projected from the second cabinet 51 toward the top surface 417 of the first cabinet, a second connecting body 66 provided to the bracket in a manner of being projected toward the second cabinet, and a fastening member 67 coupling the first connecting body 64 and the second connecting body 66 together.

The bracket may include a hub 61 fixed to the top surface of the first cabinet, a first extending body 62 extending from the hub along a width direction (i.e., an X-axis direction) of the first cabinet, and a second extending body 63 extending from the hub along a length direction (i.e., a Z-axis direction) of the first cabinet.

The bracket may further include a leg receiving part 611 receiving a leg 516 therein and a bracket perforated hole configured to perforate the bracket so that the free end of the transfer body 851 can be inserted in the bracket perforated hole. The leg receiving part 611 may be provided to the hub 61, and the bracket perforated hole may include a first bracket perforated hole 621 provided to the first extending body 62 and a second bracket perforated hole 631 provided to the second extending body 63.

To adjust a height of the second cabinet 51, the leg 516 may include a fixing body 517 fixed to the base 515 and having a female screw, an adjusting body 518 having a male screw provided to a circumferential surface so as to be coupled to the female screw, and a contact body 519 provided to a free end of the adjusting body so as to come in contact with the top surface 417 of the first cabinet. In this case, the leg receiving unit 611 may be provided as a recess or hole that provides a space for receiving the contact body 519 therein.

The free end of the transfer body 851 provided to the second detecting unit is configured to be inserted in one of the first bracket perforated hole 621 and the second bracket perforated hole 631. FIG. 4 shows one example of a case that the free end of the transfer body 851 is inserted in the first bracket perforated hole 621. In this case, the first bracket perforate dhole 621 should be located above the top surface perforated hole 418.

The first connecting body 64 may include a front connecting body 641 projected from the second cabinet 51 toward the first cabinet 41, a rear connecting body (not shown), a left connecting body (not shown) and a right connecting body 643.

Once the second handling device 5 is seated on the top surface of the first handling device 4, the front connecting body 641 and the rear connecting body will be inserted in the first bracket perforated hole 621 of the bracket provided to each corner of the top surface 417 and the left connecting body and the right connecting body 643 will be inserted in the second bracket perforated hole 631 provided to the corresponding bracket.

Therefore, if the second handling device 5 is seated on the top surface of the first handling device 4, the transfer body 851 will be pressurized toward the inside of the second cabinet 51 by the first connecting body 64.

The second connecting body 66 may include a first fixing plate 661 provided to the first connecting body 62 and a second fixing plate 663 provided to the second extending body 63. The front connecting body 641 or the rear connecting body is fixed to the first fixing plate 661 through the fastening member 67 and the left connecting body or the right connecting body 643 is fixed to the second fixing plate 663 through the fastening member 67.

An operation process of the detecting unit 7 and 8 and the first drum drive unit is described with reference to FIG. 5 as follows.

Referring to FIG. 5 (*a*), if an object such as the second handling device or the like is not seated on the top surface 417 of the first handling device, the transfer body 851 maintains a state pressurized by the spring 857 toward a direction in which the first bracket perforated hole 621 is located. In this case, the sliding body 831 will maintain a state pressurized in the direction of the first housing perforated hole 812 by the transfer recess 855 and the transfer projection 853 provided to the transfer part, whereby the free end of the support body 833 will maintain a state exposed through the front surface 411 of the first cabinet.

Therefore, if the second handling device is not seated on the top surface 417 of the first handling device, a user is unable to insert the drawer 43 into the first cabinet 41 to a position for closing the first perforated hole 415. This is because a space between the drawer panel 433 and the front surface 411 will maintain a reference distance by the support body 833.

Moreover, if the space between the drawer panel 433 and the front surface 411 maintains the reference distance, the magnetic force detecting unit 73 is unable to detect a magnetic force (e.g., a magnetic force equal to or greater than a reference value) of the magnet 71 fixed to the drawer, whereby the first controller does not activate the first drum drive unit.

Meanwhile, referring to FIG. 5 (*b*), if an object is seated on the top surface 417 of the first cabinet, the transfer body 851 moves in a direction getting away from the first bracket perforated hole 621 (e.g., a direction in which a bottom surface of the housing is located). In this case, since the sliding body 831 will be moved in a direction getting away from the first housing perforated hole 812 by the transfer recess 855 and the transfer projection 853, the support body 833 will move toward the inside of the first cabinet 41 (i.e., the inside of the housing body).

Once the second handling device is seated on the top surface 417 of the first handling device, a user may insert the drawer 43 into the first cabinet 41 to a position for closing the first perforated hole 415 and the magnetic force detecting unit 73 may detect a magnetic force (e.g., a magnetic force equal to or greater than a reference value) of the magnet 71 fixed to the drawer. Therefore, the first controller can activate the first water supply part, the first drum drive unit and the first drain part in response to a control command inputted through the input unit of the first control panel 435.

It will be apparent to those skilled in the art that various modifications and variations can be made in the present application without departing from the spirit or scope of the inventions. Thus, it is intended that the present application covers the modifications and variations of this invention provided they come within the scope of the appended claims and their equivalents.

What is claimed is:

1. An apparatus for treating laundry, comprising:

a cabinet having a front surface provided with a first perforated hole and a second perforated hole, and a top surface provided with a top surface perforated hole;

a drawer drawable from the cabinet through the first perforated hole;

a drum rotatably provided within the drawer to provide a space for storing the laundry therein;

a slide exposed to the front surface of the cabinet through the second perforated hole to maintain a state that the drawer is drawn from the cabinet; and a transfer part exposed to the top surface of the cabinet through the top surface perforated hole and configured to move into the cabinet by pressurization, wherein the slide is configured to move into the cabinet when the transfer part moves into the cabinet by pressurization.

2. The apparatus of claim 1, wherein the slide is arranged to be slidable in a drawable direction of the drawer, the slide having an inclined part formed at a position corresponding to the transfer part, the slide being configured to move rearward by contacting with the transfer part when the transfer part moves downward into the cabinet by pressurization.

3. The apparatus of claim 2, wherein the inclined part is formed to slope downward toward the second perforated hole.

4. The apparatus of claim 3, wherein the slide further comprises a first body extended in the drawable direction, wherein the first body comprises a transfer recess in which the inclined part is formed, wherein the transfer part comprises a transfer body extended in a direction toward to the top surface and having one end located within the cabinet and the other end exposed to the top surface perforated hole, and wherein the transfer body comprises a transfer projection configured to move the first body in the drawable direction while moving along the transfer recess.

5. The apparatus of claim 4, wherein the slide further comprises a second body extended from the first body in a direction orthogonal to the drawable direction and arranged to be movable in the drawable direction together with the first body.

6. The apparatus of claim 3, wherein the slide further comprises a vertical space formed in a vertical direction above the highest portion of the inclined part so that the transport unit can move downward.

7. The apparatus of claim 1, further comprising a housing providing a space therein, wherein the housing comprises a first housing perforated hole corresponding to the second perforated hole and formed at a front surface of the housing, and a second housing perforated hole corresponding to the top surface perforated hole and formed at the top surface of the housing, and wherein a portion of the slide and the transfer part are disposed inside the housing, and a portion of the slide and the transfer part are disposed to be movable through the second housing perforated hole and the first housing perforated hole, respectively.

8. The apparatus of claim 7, wherein the housing further comprises a guide formed along the drawable direction to support and guide a moving of the slide.

9. The apparatus of claim 8, wherein the guide comprises a first guide that guides the slide to enable reciprocating movement.

10. The apparatus of claim 9, wherein the guide further comprises a slit guide connecting the first guide to a top end of the housing.

11. The apparatus of claim 7, wherein the slide further comprises:

a support body configured to be inserted in the second perforated hole and the first housing perforated hole and moving in the drawable direction and a stopper limiting a drawn distance of the slide.

12. The apparatus of claim 1, further comprising:

a magnet provided to one of the drawer and the cabinet;

a magnetic force detecting unit provided to the other one of the drawer and the cabinet to detect a magnetic force of the magnet; and a controller activating the drum drive unit only if the magnetic force detecting unit detects the magnetic force of the magnet.

* * * * *